United States Patent [19]

Milbauer et al.

[11] Patent Number: 4,871,201

[45] Date of Patent: Oct. 3, 1989

[54] RECESSED LATCH DEVICE

[75] Inventors: Thomas H. Milbauer, Marion; LeDell E. Benson, Clintonville, both of Wis.

[73] Assignee: Marion Body Works, Inc., Marion, Wis.

[21] Appl. No.: 201,044

[22] Filed: May 31, 1988

[51] Int. Cl.[4] ..... E05C 5/02

[52] U.S. Cl. ..... 292/113; 160/328

[58] Field of Search ..... 292/113, 196, 218, 345, 292/DIG. 46, DIG. 49, 246; 160/327-329

[56] References Cited

U.S. PATENT DOCUMENTS 1,772,326 8/1930 Smith ..... 292/113 X 2,699,206 1/1955 Banner et al. ..... 160/328

2,880,797 4/1959 Alvarey et al. ..... 160/328

3,844,591 10/1974 Velcover ..... 292/113

*Primary Examiner*—Richard E. Moore

*Attorney, Agent, or Firm*—Foley & Lardner

[57] ABSTRACT

A recessed latch mechanism for closing and maintaining closed a flexible covering across the side of truck bodies, truck trailer or the like. The latch mechanism has a gripping arm connected to a rotatable shaft through an intermediate curved member. When the shaft is rotated from an open position to a closed position, the curved member closely abuts the shaft along its entire curved portion. The gripping arm substantially encloses the other components of the latch mechanism.

23 Claims, 3 Drawing Sheets

RECESSED LATCH DEVICE

BACKGROUND OF THE INVENTION

This invention relates to latch devices for tensioning and latching flexible covers and more particularly for the tensioning and latching flexible sides covers on truck bodies, truck trailers and the like.

Where it is desired to quickly load or unload truck bodies, trailers, vans and similar storage containers, it is desirable to have fule access thereto through the sides thereof. Sliding doors and the like are generally the structures used to provide ready egress into the truck body or trailer interior. Flexible side covers have found increasing application, however. An example of a flexible member of the accordian type is disclosed in U.S. Pat. No. 4,545,611 issued Oct. 8, 1985 and assigned to Tautliner, Inc. Another example disclosing the use of flexible material such as tarpauline may be found in U.S. Pat. No. 4,092,039 issued May 30, 1978.

Flexible side covers require proper sealing and tensioning, a problem which is addressed to some extent by the aforementoned U.S. Pat. No. 4,092,039. Such prior art arrangements, however, have not proven entirely satisfactory due to the complexity of the latching and tensioning device, relative size hindering egress into the truck body or trailer interior, and the too frequent failure of such devices due to the severe operating conditions to which the devices are often exposed.

SUMMARY OF THE PRESENT INVENTION

In accordance with one embodiment of the present invention, a latching device, extremely suited for use with truck bodies, truck trailers, vans and like storage containers where the side walls are flexible coverings, comprises a rotatable member appropriately secured to a stationery post of the trailer, a gripping arm which fastens to one end of the flexible covering, and a curved linking element which is pivotably secured at one end to the rotatable member at a position on the circumference thereof and at the other end to a curved end portion of the gripping arm. The rotatable member is capable of rotating from an open position in which the gripping arm secures one end of the flexible side cover to a closed or locked position in which the curved link member and the curved end portion of the gripping arm are placed in an abutting relationship with the rotatable member along substantially the entire curved surfaces of the link member and end portion. The rotatable member is coupled to a force member, which together collectively have predetermined mechanical advantage ratio. A planar side of the gripping arm provides a cover to the latching device of the present invention when in the closed position, and encloses substantially all of the components thereof in a flush relationship with the stationary post and tensioned flexible covering.

BRIEF DESCRIPTION OF THE DRAWINGS

A preferred exemplary embodiment of the present invention will hereinafter be described wherein like numerals denote like elements and.

DETAILED DESCRIPTION OF THE PREFERRED EMBODIMENT

Figure 1:
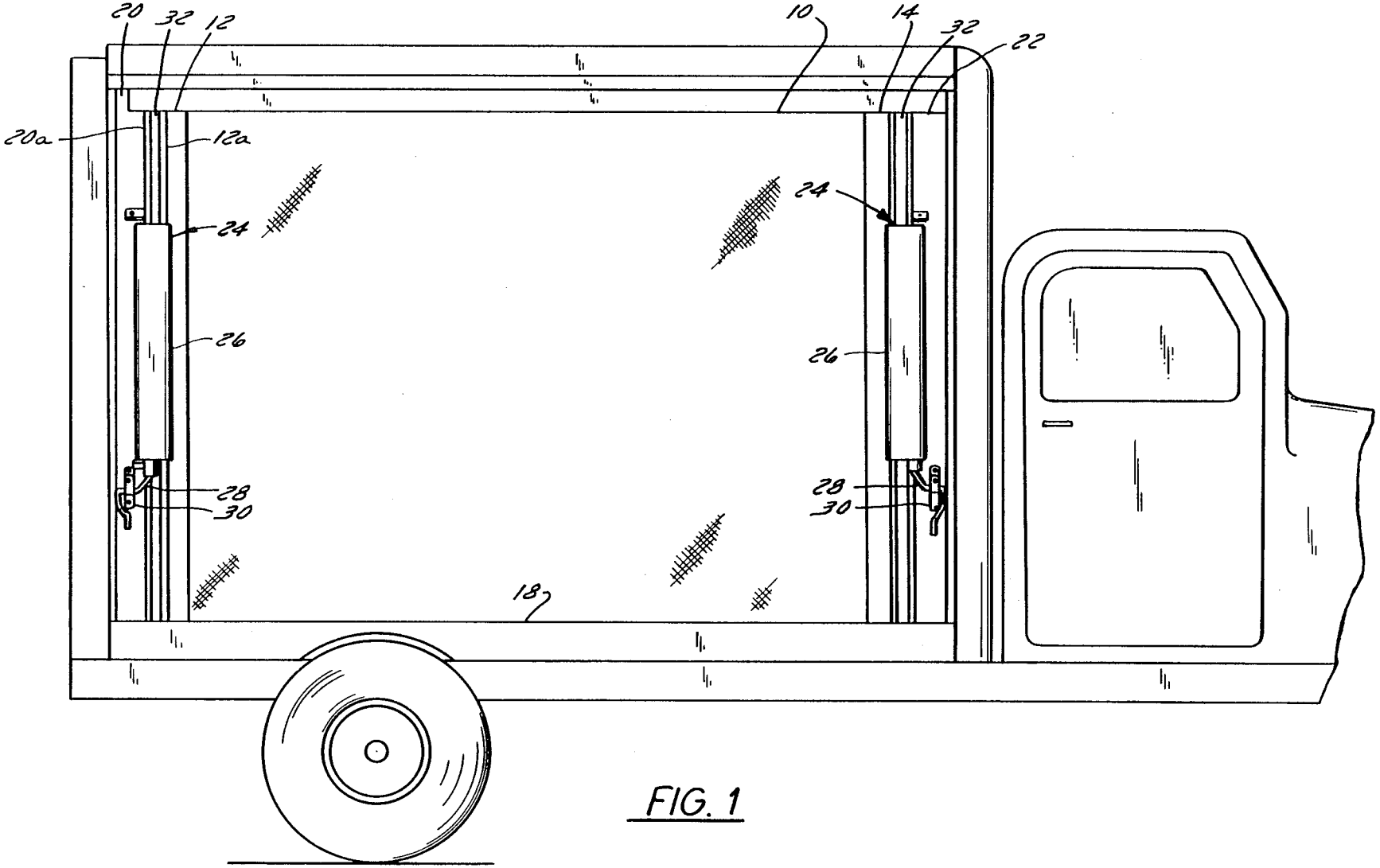
FIG. 1 is a side view of a truck body and similarly a trailer, or container having flexible side walls and which incorporates a latch device in accordance with the present invention.

Reference is made briefly to FIG. 1 depicting a vehicle having a straight truck, under a van body with a flexible side wall 10 with both side ends thereof secured to moveable posts 12 and 14. The flexible side wall 10 is illustrated as being secured at both ends thereon to posts 20, 22 respectively, via a pair of recessed latch mechanisms 24. Each latch mechanism 24 has a latch gripping arm 26, a portion of which serves to cover the latching components of mechanism 24 with the exception of lever arm 28 shown in a cooperative locked position with lever arm catch mechanism 30 mounted on posts 20 (and 22). A flexible valance may be employed to cover the mechanism 24 and the top of the side walls while a flexible curtain may be used to cover the bottom of the mechanism.

From the view of FIG. 1, it may be recognized that the latch device of the present invention is admirably suited for operation by an individual standing on the ground, a platform or dock. Typically, in truck and truck-trailer installations the flexible side wall extends from about four (4) feet above ground level to about twelve (12) feet. As discussed hereinafter, the mechanical advantage of the latch device is designed to permit operation by individuals having substantially less strength than the average adult male.

Figure 2:
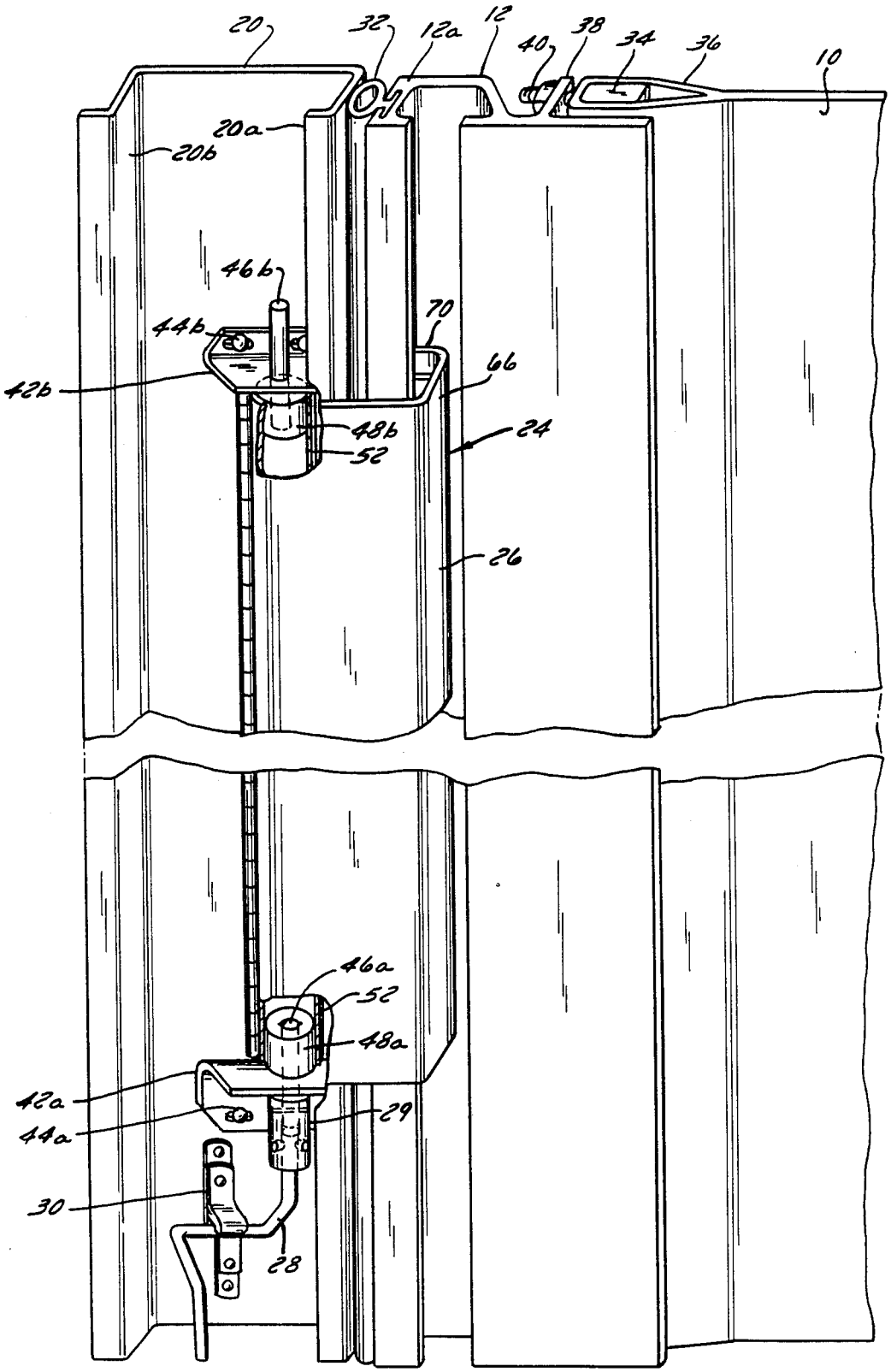
FIG. 2 is a perspective view of the latched device of the present invention with portions of the planar part of the gripping arm broken away to show the underlying components.

FIG. 2 depicts in greater detail exterior components of latch mechanism 24. As illustrated, mechanism 24 is in a latched or closed position in which stationary post 20 is in a water tight abutting relationship with flexible seal member 32 secured to flange 12*a* of moveable post 12. The moveable post 12 may be made of any material sufficiently rigid to place seal member 32 into a compressed relationship with the stationary post 20 and, having mechanical and chemical integrity to withstand repeated opening and closing, the rigors of vibration caused by movement of the vehicle and exposure to weather and able to be fastened to the flexible side wall 10. Aluminum alloy 6061-T6 or 6063-T6 has been found to be extremely suitable for this purpose. Flexible seal member 32 should also provide adequate compressibility and shock absorption characteristics such that normal jolts and vibrations occurring during operation of the vehicle are absorbed by the seal member 32. Materials such as EPDM/neoprene have been found suitable for seal member 32.

The end of the flexible side wall 10 may be fastened to moveable post 12 in various ways. The one illustrated has a rigid member 34 positioned within a loop 36 made in the end of the fabric of side wall 10. The rigid member 34 may be bolted to flange 38 extending out from post 12 by a plurality of bolts 40.

Figure 3:
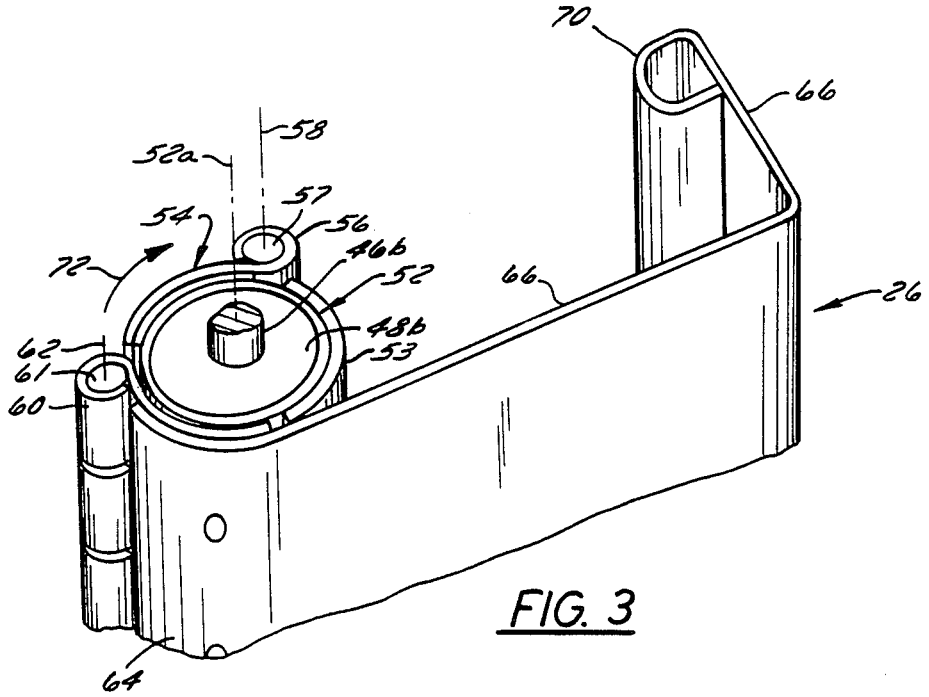
FIG. 3 is a view taken along lines 3—3 when the latched device in an open position.

A pair of adjustable angle brackets 42*a*, 42*b* are mounted on the interior wall of post 20 via slotted holes 44*a*, 44*b* and bolted thereto. Angle brackets 42*a* and 42*b* each support and provide a bearing for, respectively, a stub shaft 46*a* and 46*b* which in turn mount and are welded to or otherwise keyed to bushings 48*a* and 48*b*. A cylindrically shaped sleeve 52 of a predetermined diameter is mounted about each bushing 48*a* and 48*b* and welded or otherwise secured to sleeve 52 for rotation relative thereto about a substantially vertical axis 52*a* (as seen in FIG. 3). Bushings 48*a* and 48*b* provide support for sleeve 52. Lever arm 28 may be coupled directly to the bottom of sleeve 52, or as illustrated, preferably coupled through an intermediate adjustment collar 29.

Angle brackets 42*a* and 42*b* provide a useful adjustment by allowing for lateral movement thereof along slotted holes 44*a* and 44*b* in the event of expansion or shrinkage of the flexible material. Adjustment collar 29 permits adjustment of arm 28 with respect to sleeve 52.

The material employed for sleeve 52 may be corrosive resistant stainless steel or the like that can be welded or otherwise secured to bushings 48*a* and 48*b*. Bushings 48*a* and 48*b* may, for example, be comprised of stainless steel or other similar corrosion resistant material.

As shown, lever arm 28 imparts direct manual rotational movement to sleeve 52, but other mechanisms having various or variable mechanical advantages may be employed as well. Positive acting latch mechanism 30 mounted on a post having a snap-lock feature is used to latch lever arm 28 in place when not in use and may be secured with padlock or other locking mechanism for load security.

Figure 4:
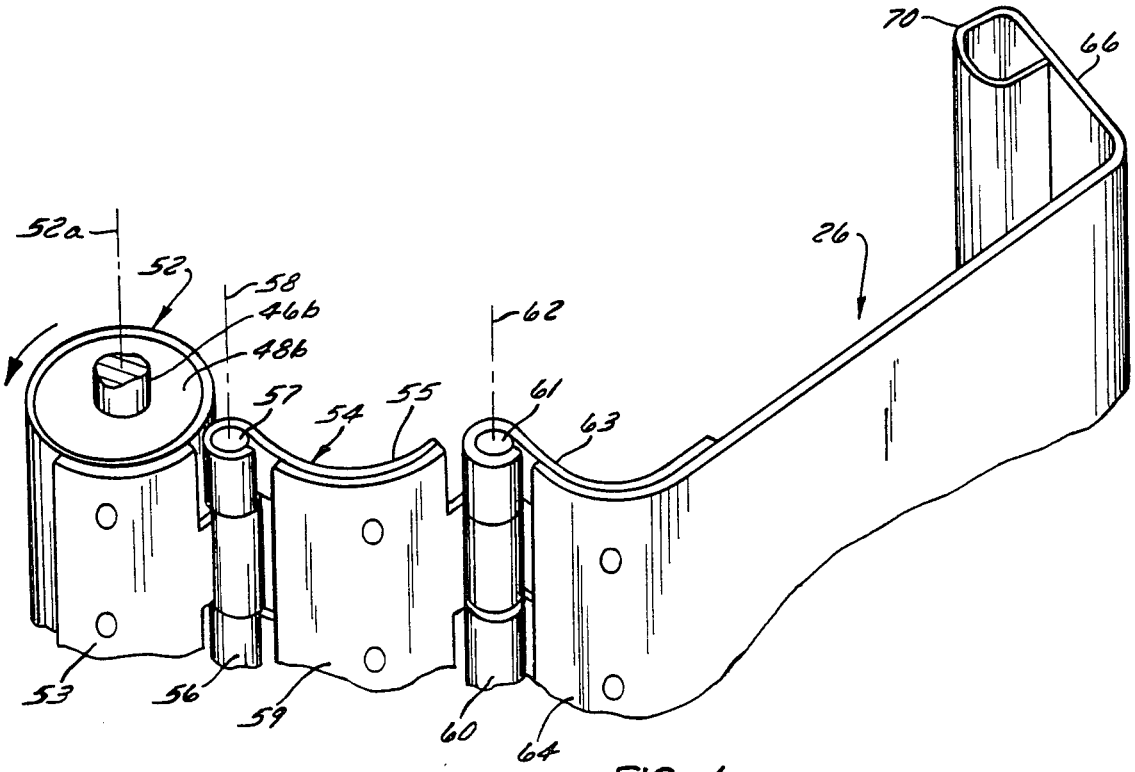
FIG. 4 is a view taken along lines 3—3 when the latched device is in a closed position.

As depicted in FIGS. 3 and 4, rotatable sleeve 52 is fixedly secured by appropriate means to curved segment 53 which terminates in hinge knuckles complimentary with knuckles of curved segment 55 of spanner 54, forming a hinge 56 about hinge pin 57. Spanner 54 itself is comprised of curved segment 55 appropriately rigidly secured to a second curved segment 59. The other end of segment 59 terminates in hinge knuckles complimentary to knuckles formed in the terminal end of segment 63 of the curved arm portion 64 of arm 26, forming a second hinge 60 about hinge pin 61. Hinge pins 57 and 61 respectively provide pivot axis 58 and 62 for purposes to be described.

Spanner 54 has a curved shape which, as shown in FIG. 3, conforms to the curvature of sleeve 52 and is in an abutting relationship thereto when latch mechanism 24 is in the closed position. Although a single spanner 54 is illustrated here, it is contemplated that a plurality of connected spanners may be employed depending upon the geometry of the components and applications desired.

The portion 64 of arm 26 closest to hinge 58, including segment 63, is also curved to conform to the curvature of sleeve 52 such that portion 64 will closely abut sleeve 52 as illustrated in FIG. 3. Arm 26 has a planar portion or panel 66 extending from curved segment 63 and ends in a right angle gripping flange 68 and terminating in folded end 70. As best seen in FIG. 2, sleeve 52 is positioned such that the circumference of sleeve 52 is approximately tangent to or extends slightly beyond the planar surface defined the side surfaces of the posts 12 and 20. Hinge 56 is located on the circumference of sleeve 52 and in the open position of FIG. 4 is rotated to a position where its pivot axis 57 is on or slightly outside of the defined planar surface.

As flange 66 grips the flange 12*a* of post 12, appropriately dimension to permit folded end 70 to be positioned behind it, and a force is applied, spanner 54 and arm 26 are straightened such that hinge axis 62 also becomes located on the defined planer surface. Arm 26 then pulls post 12 and flexible side 10 toward post 20. When lever arm is initially rotated, a maximum mechanical advantage is available which is advantageous since the initial tensioning movement may require the most mechanical advantage. The mechanical advantage is derived from the ratio of the length of lever arm 28 to the diameter of sleeve 52 and can be easily be varied by changing either or both of those dimensions.

As pivot axis 58 follows the rotation of sleeve 52, it soon rotates an angle of greater than 180° measured along the circumference of sleeve 52, causing spanner 54 and curved segment 63 to follow and wrap around sleeve 52 along the entire curved surfaces of each. In FIG. 3, it may be seen that both hinges 56 and 60 are abutting sleeve 52 along with spanner 54 and arm portion 64 of tension arm 26. In the closed position, the latching device tends to hold itself in the closed position because hinge 60 has rotated to a position slightly behind the axis 52*a*; thus the tension force tends to pull hinge 60 in the direction of arrow 72 which is opposite to the direction needed to open latch 24.

Once seal 32 impacts against stationary post 20, it compresses providing the desired weather proof seal and shock absorber characteristics and allows for a build-in spring like action for uniform tensioning under large variations due to temperature extremes.

It is important to note that the positioning of sleeve 52 inside the channel defined by flanges 20*a* and 20*b* of post 20 and therefore inside the planar surface defined by the exterior surfaces of the posts 20 (and 22) and flexible side wall 10, minimizes possible destructive damage thereto and affords easy access to the interior of the vehicle. Because arm 26 extends from a position adjacent to or abutting sleeve 52 across both flange 20*a* of post 20 and flange 12*a* of post 12, when latch 24 is closed, sleeve 52 and associated components are substantially closed. The covering feature is not only esthetically pleasing but tends to minimize effects of corrosive materials splashed against side wall 10 and exterior when the vehicle is moving.

As stated previously, the number of spanners employed is a matter of choice depending upon the application desired and the geometry of the other components. Similarly, the arc circumscribed by the spanners and the arm portion 64 are both dependent upon other factors. As illustrated, the arc circumscribed by spanner 54 is about 185°.

It will be understood that the foregoing description is of a preferred exemplary embodiment of the present invention and that the invention is not limited to the specific forms shown. Modifications may be made in design and arrangement thereof within the scope of the present invention, as expressed in the appended claims.

We claim:

1. A latching mechanism for releaseably securing and tensioning one end of a cover comprising:

(a) rotatable means including a rotatable curved member for rotating from an open position to a closed position;

(b) securing means for releasably latching said one end of said cover; and (c) linking means including at least one curved segment for pivotably connecting said rotatable means to said securing means, said curved segment abutting said curved member and having a center of curvature approximately the same as said curved member when said rotatable means is in said closed position.

2. The latch mechanism of claim 1 in which said curved member is a cylindrical member mounted for rotational movement between said open and closed positions and said curved segment is pivotably secured to said cylindrical member.

3. The latch mechanism of claim 2 in which said cylindrical member is pivotably secured to one end of said curved segment and said securing means includes an arm pivotably secured to an other end of said segment.

4. The latch mechanism of claim 3 in which a portion of said arm abuts said cylindrical member when said rotating means is in a closed position.

5. The latch mechanism of claim 4 in which said portion of said arm has a center curvature approximately the same on said cylindrical member.

6. The latch mechanism of claim 5 including means for rotating said cylindrical means coupled to said cylindrical member at one end thereof, said arm having a width extending substantially the axial length of said cylindrical member.

7. The latch mechanism of claim 6 in which said curved segment has a width extending substantially the axial length of said cylindrical member.

8. The latch mechanism of claim 1 in which said curved segment is pivotably connected at one end to said curved member and at the other end to said securing means.

9. The latch mechanism of claim 8 in which said curved member rotates approximately 185° between said open and closed positions.

10. The latch mechanism of claim 9 in which the axis of rotation between said curved member and said curved segment and the axis of rotation between said curved segment and said securing means are separated by an arc of about 105° along the surface of said curved member when said rotating means is in the closed position.

11. A latch mechanism for securing a flexible side cover on a truck comprising:

(a) a stationary post member mounted in a substantial vertical position;

(b) a cylindrical tube;

(c) means for rotatably securing said tube to said post member;

(d) means for rotating said cylindrical tube about its center of rotation from an open position to a closed position;

(e) first hinge means for pivotably securing one end of a curved link to said cylindrical tube;

(f) a latch arm;

(g) second hinge means for pivotably securing the other end of said curved link to one end of said latch arm; and (h) said curved segment in close abutting conformity to said cylindrical tube when said tube is in said closed position.

12. The latch mechanism of claim 11 in which a portion of said latch arm is curved and in an abutting relationship with said tube when said tube is in a closed position.

13. The latch mechanism of claim 12 in which said first hinge means extends along a major portion of the length of said tube and said one end of said curved segment and said second hinge means extends along a major portion of said other end of said curved segment and said one end of said latch arm.

14. The latch mechanism of claim 13 in which said portion of said latch arm has curvature which is in close abutting conformity to said cylindrical tube when said tube is in said closed position.

15. The latch mechanism of claim 11 in which said first hinge means has a pivot axis which moves approximately 185° around said cylindrical tube axis between said open and closed positions.

16. The latch mechanism of claim 15 in which said pivot axes are positioned approximately 125° apart around said cylindrical tube when in said closed position.

17. The latch mechanism of claim 11 in which said second means is in an abutting relationship with said cylindrical tube in the closed position such that the force of tension acting on said hinge means is directly along a line behind said center of rotation of said tube.

18. The latch mechanism of claim 11 in which said stationary post member and said flexible cover have exterior surfaces which are approximately in the same plane, said cylindrical tube and said rotatable securing means positioned largely interior to said plane.

19. The latch mechanism of claim 18 in which said first hinge means has a pivot axis located adjacent said plane when said tube is in the open position.

20. The latch mechanism of claim 19 in which said latch arm has a curved portion which abuts said cylindrical tube in close conformity when said tube is in a closed position.

21. The latch mechanism of claim 20 in which one end of said side cover is secured to a moveable post and said latch arm has gripping means for gripping said moveable post on a side opposite said cylindrical tube.

22. The latch mechanism of claim 21 in which said latch arm has a planar surface which extends from a position adjacent said cylindrical tube to said opposite side of said moveable post when said cylindrical tube is in the closed position.

23. The latch mechanism of claim 22 in which said moveable post has a seal secured thereto, said seal abutting said stationary post when said cylindrical tube is in said closed position.

* * * * *